US006213321B1

(12) United States Patent
Zumbuhl

(10) Patent No.: US 6,213,321 B1
(45) Date of Patent: Apr. 10, 2001

(54) THREADED CLOSURE FOR PRESSURIZED CONTAINERS

(76) Inventor: Bruno Zumbuhl, 1801 N. Kentucky Ave., Evansville, IN (US) 47711

( * ) Notice: Subject to any disclaimer, the term of this patent is extended or adjusted under 35 U.S.C. 154(b) by 0 days.

(21) Appl. No.: 09/305,918

(22) Filed: May 6, 1999

Related U.S. Application Data

(63) Continuation of application No. 08/490,533, filed on Jun. 14, 1995, now abandoned.

(51) Int. Cl.[7] ..... B65D 41/32; B65D 41/34
(52) U.S. Cl. ..... 215/252; 215/253; 215/258
(58) Field of Search ..... 215/252, 216, 215/218, 258, 253, 208, 217, 223, 250, 329

(56) References Cited

U.S. PATENT DOCUMENTS 4,667,838 * 5/1987 Yeager ..... 215/252
4,784,280 * 11/1988 Breuer et al. ..... 215/252
4,801,030 * 1/1989 Barriac ..... 215/258
4,978,017 * 12/1990 McBride ..... 215/258
5,107,998 * 4/1992 Zumbuhl ..... 215/252
5,356,019 * 10/1994 Kelly ..... 215/252
5,402,901 * 4/1995 Carvalheiro et al. ..... 215/252

FOREIGN PATENT DOCUMENTS

0508396 * 10/1992 (EP) ..... 215/252

* cited by examiner

*Primary Examiner*—Allan N. Shoap
*Assistant Examiner*—Niki M. Eloshway
(74) *Attorney, Agent, or Firm*—Charles E. Temko

(57) ABSTRACT

A threaded closure for pressurized containers, typically for carbonated beverages is disclosed. The closure includes a deformable liner of non-vinyl polymer which is cold formed in the closure using known techniques in such manner that the liner physically bonds to the inner surface of the end wall of the closure to be retained thereby in the absence of a peripheral lip or projections on the inner surface of the end wall of the closure. The closure itself may be either injection molded or compression molded. The usual tamper indicating ring is formed to include frangible bridge members either by molding or a separate slitting operation. The pivotally mounted tabs for separating the tamper-indicating ring are sufficiently rigid to avoid flexing at points other than at an outer edge hinge axis where pivoting is possible only to a limited degree, thus assuring the severing of the frangible bridge members at an early stage of opening of the closure.

6 Claims, 2 Drawing Sheets

10
11
12
13
14
15
20
21
22
24
25
26
27
28
40
42
43
44
45
46
48
49
50
52
53
67
71
72
73

THREADED CLOSURE FOR PRESSURIZED CONTAINERS

This application is a continuation of my application, Ser. No. 08/490,533 filed Jun. 14, 1995 now abandoned.

BACKGROUND OF THE INVENTION

This invention relates generally to the field of threaded closures for containers, and more particularly to synthetic resinous closures of relatively small diameter employed to seal containers of pressurized contents, typically soft drinks, beer and other carbonated comestibles. Traditionally, such containers have been sealed using metallic caps commonly referred to as crown closures requiring the use of a tool for removal. Over the past fifteen to twenty years, such closures have been almost completely replaced by a synthetic resinous closure either injection molded, or, more commonly, compression molded. Such closures are usually provided with a tamper-evident ring which depends from the lower edge of the cylindrical side wall of the closure, and is interconnected to said edge by frangible bridges formed during the molding operation, or by a separate slitting operation. Annual production of said closures surpasses that of other types of closures, and, not surprisingly, the art relating to such closures is in a highly developed state.

Although synthetic resinous closures of this type have many advantages, including the ability to be removed without the use of a tool, and the ability to reseal the container where all of the contents are not consumed upon first opening, they do present significant problems during manufacture.

One of the problems concerns the formation of a sealing liner beneath the inner surface of the end wall of the closure. The material used in forming the closure, while possessing a degree of resilience, is normally not possessed of adequate cold flow properties to form a gas tight seal against the mouth of the container neck or finish. This function is normally provided by forming a liner of softer synthetic material in situ using the closure as a female part of the mold in conjunction with a reciprocating male part which flattens and shapes a measured quantity of material. The closure is provided with an inwardly projecting lip which is of lesser diameter than the internal thread diameter forming an undercut or recess which shapes the rim of the flattened seal. That portion of the rim of the seal disposed immediately inwardly of the lip engages the end surface of the mouth of the finish to effect a gas tight seal. It is usual to form that portion to a slightly thicker cross section for greater resiliency. This construction does not permit the formation of a sealing effect which extends outwardly beyond the inner edge of the lip.

A more serious problem lies in the provision of frangible ribs or bridges which interconnect the lower edge of the side wall or skirt of the closure with the tamper-indicating band or ring. The bridges must be sufficiently strong so as to avoid breaking when the closures are installed, either by threading or pressing the closures into position, and yet be capable of readily fracturing when the closure is unthreaded. To this end, designs have included the provision of some bridge members which are stronger than other bridge members and are positioned in specific locations, this construction being partially successful when the tamper-evident ring is split and remains attached to the skirt during removal of the closure. Other constructions provide for a camming action utilizing inclined surfaces at the lower edge of the skirt and the upper edge of the tamper-indicating ring.

The most common construction used for fracturing the bridges is the use of flexible wings or tabs. One form uses tabs which engage the outer surface of the finish to prevent rotation of the ring relative to the skirt. More commonly, the tabs are pivoted about an axis normal to the axis of the closure and have free ends which engage beneath a radially projecting bead on the outer surface of the container finish. The tabs are not only pivoted relative to the inner surface of the ring, but are flexible as well to permit easy removal without damage from a forming mold. The relatively thin cross section required to produce this flexibility has an adverse result in that the tabs are occasionally not sufficiently rigid to assure prompt breakage of the bridges when the closure is unthreaded. This problem is accommodated by the provision of a radially inwardly extending band on the inner surface of the ring against which the tabs are engaged after being folded through approximately 135 degrees. This engagement reduces the effective diameter of the bead on the tamper-indicating ring to less than that of the corresponding bead on the outer surface of the container, so that it cannot pass the bead on the container, and continued unthreading of the closure serves to break the bridges. The use of this construction is almost mandatory where the bridges are of unequal strength. However, this construction in its so-called second mode of operation requires a substantial degree of unthreading of the closure before the bridges are broken, and no substantial leverage is obtained.

SUMMARY OF THE INVENTION

Briefly stated, the invention contemplates the provision of an improved closure of the type described in which the above-mentioned problems have been either eliminated or substantially ameliorated.

At the upper part of the closure, the seal retaining lip forming an undercut portion which retains the seal in position has been eliminated through the use of superior seal-forming materials permitting the seal to be of greater diameter than heretofore possible to present a greater sealing surface to the peripheral edge of the mouth of the closure. The seal, once cold formed within the closure, bonds to the inner surface of the end wall thereof without the necessity of interlocking projections or surfaces, and is incapable of relative rotation therebetween.

At the opposite end of the closure, the above-described relatively complicated flexible tab construction is substituted by hingedly interconnected tabs which are of sufficient cross section to preclude flexing, so as to assure that the free ends thereof will exert an unyielding leveraged force to the undersurface of the container bead to positively fracture the tamper-indicating ring bridges, without the necessity of providing a secondary mode for that purpose. The cross-sectional shape of the tabs is such that they can be readily removed from a mold without damage or difficulty.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figures 1, 2:
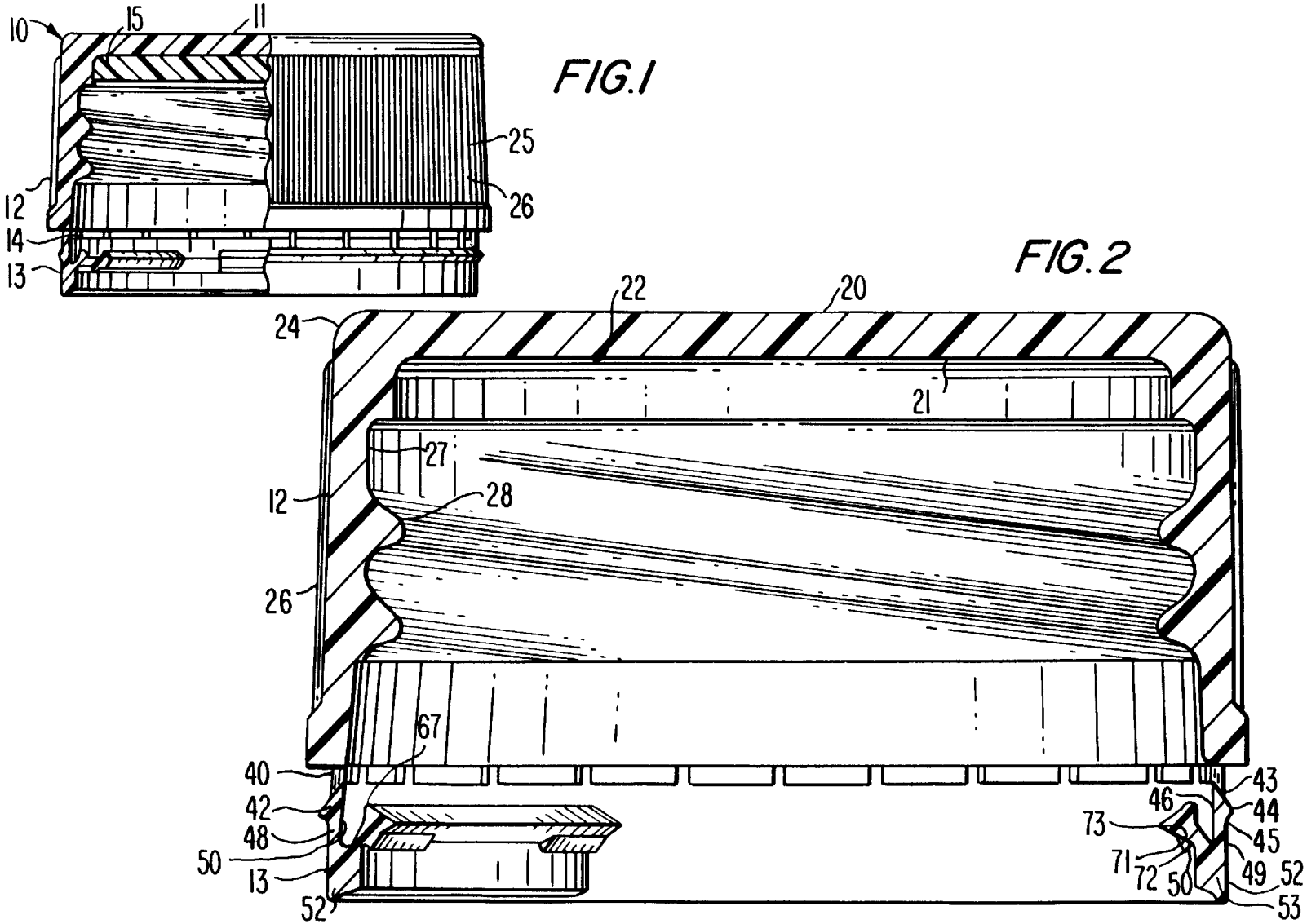
FIG. 1 is a side elevational view of an embodiment of the invention, partly in central section.
FIG. 2 is an enlarged fragmentary sectional view corresponding to the upper left-hand portion of FIG. 2.

In accordance with the invention, the device, generally indicated by reference character 10 is of conventional configuration, including an end wall 11, a side wall or skirt 12, a tamper-indicating ring 13 interconnected by frangible bridges 14, and a resilient liner 15. Most conveniently, the device, exclusive of the liner 15, is either compression molded or insert molded from polypropylene or synthetic resinous materials having similar properties. Using techniques known in the art, the liner 15 is formed by depositing a measured quantity of polymeric material in a recess in the inner surface of the end wall.

Figure 4:
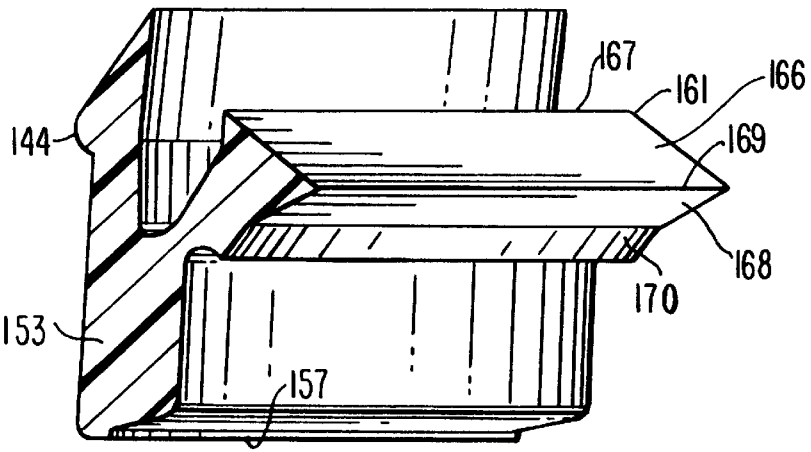
FIG. 4 is a fragmentary view in perspective showing a first alternate construction.

The end wall 11 is bounded by an outer surface 20 and an inner surface 21 which defines a recess 22 in which the liner 15 is formed. It meets with the side wall 12 at a rounded edge 24. The side wall 12 is bounded by an outer surface 25, preferably having finger-engaging striations 26 thereon, as well as an inner surface 27 having an upper threaded portion 28. The tamper-indicating ring 13 is interconnected to the lower edge of the side wall 12 by frangible bridges 40. The ring 13 includes an upper tapered section 42 bounded by an outer surface 43 and a rounded surface 44 which terminates in a lower edge 45. An inner surface 46 is slightly tapered and extends downwardly to the area of the edge 45. A medially positioned section 48 is of relatively thin cross section, and is bounded by an outer surface 49 and an inner surface 50. A lower section 52 includes an annular main body 53 of relatively thicker cross section bounded by an upper radially extending surface 54 and an inner cylindrical surface 55 which extends to a lower tapered surface 56 which meets a downwardly extending bead 57. The surfaces 54 and 55 meet in an area of relatively thin cross section indicated by reference character 60, from which extend a plurality of hinged tabs 61, conveniently eight in number. The tabs, in unstressed condition, extend inwardly at approximately thirty degrees with respect to the principal axis of the closure and are generally triangular in cross section. Each tab is bounded by an outwardly extending surface 65, an end surface 66 which meets the surface 65 in a rounded bead 67. An inner surface 68 extends downwardly from the end surface 66 from an edge 69 to the area of thin cross section 60 which forms a hinge for the tab which is relatively rigid. Extending from the surface 68 are a pair of shaped projections 70 bounded by first and second surfaces 71 and 72 and end surfaces 73. Referring to FIG. 4 in the drawing, it will be observed that these projections are adapted to contact the surface 55 which determines the limit of the path of travel which the tabs may execute when the container is unthreaded. In this position, the outer surface 65 is disposed at approximately 49 degrees with respect to the principal axis of the closure, whereas in unstressed condition, the surface is disposed at approximately 20 degrees from the principal axis. Thus, the tabs operate only in a single mode in which they are in relatively upright condition, thus assuring a rapid breaking of the frangible bridges during the initial portion of the unthreading operation which removes the closure from the container. While pivoting inwardly, a considerable degree of leverage is obtained whereby the manually transmitted force exerted by the user to unthread the closure is substantially reduced.

Figure 5:
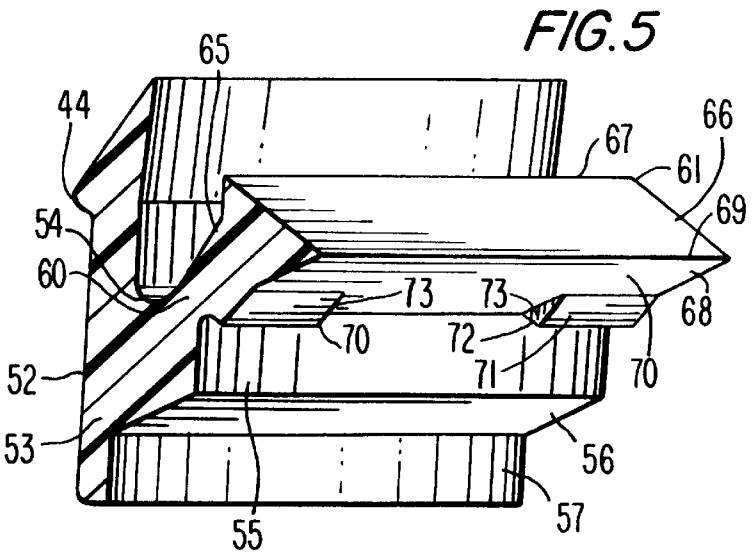
FIG. 5 is a fragmentary view in perspective showing a second alternate construction.
Figure 6:
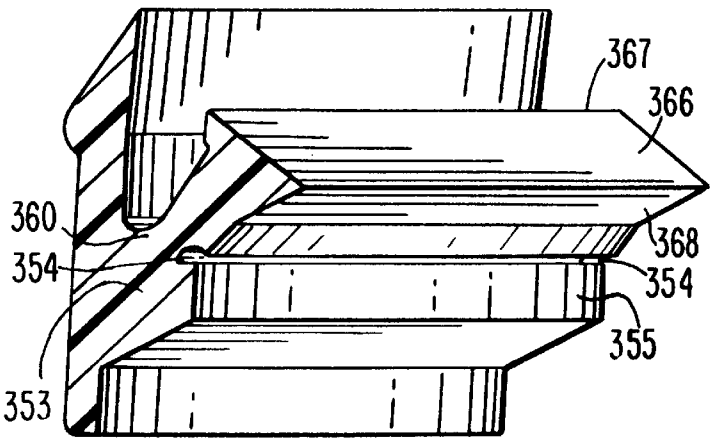
FIG. 6 is a fragmentary view in perspective showing a third alternate construction.

Turning now to FIGS. 4, 5, and 6 in the drawings, there are illustrated three alternate constructions, in which, to avoid needless repetition, certain of the component parts corresponding to those of the principal embodiment have been designated by similar reference characters with the additional prefixes "1", "2", and "3".

In the form illustrated in FIG. 4, the projections 70 have been replaced by a single projection 170 to provide slightly greater rigidity to the tab when flexed to its inward limit of travel.

In the form shown in FIG. 5, the annular main body 253 is shortened in height, to form a somewhat larger bead 257, thereby saving a degree of material from which the device is molded.

In the form illustrated in FIG. 6, the annular main body 353 is extended inwardly beneath the area of thin cross section 360, so that the tab contacts the upper radial surface 354 rather than the inner cylindrical surface 355 when flexed, this construction being particularly suitable where the tamper ring is not split upon removal of the closure.

The invention will be best understood from a comparison of the disclosed structure herein with that disclosed in my prior U.S. Pat. No. 5,107,998 granted Apr. 28, 1992 under the title "Tamper Proof Ring For Threaded Containers".

Figure 3:
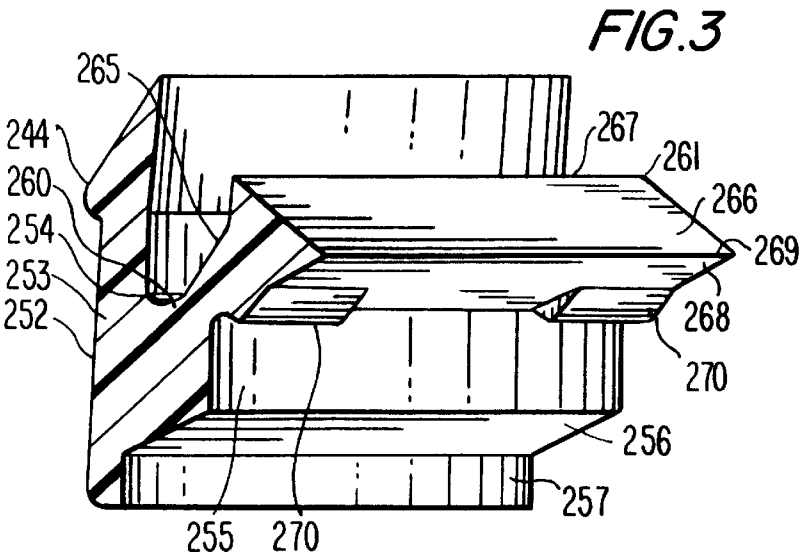
FIG. 3 is a fragmentary enlarged view in perspective showing the structure of hingedly mounted tabs for fracturing frangible bridge structures interconnecting a closure skirt with a tamper-indicating ring.

In my prior patent, the disclosed tamper-indicating ring includes an inwardly directed lower flange which supports a plurality of hook-like members, i.e. tabs, against movement past a predetermined point when the closure is unthreaded. The base of the tabs is formed to interconnect with a curved outer portion of the upper surface of the supporting flange (See FIG. 3), so that when the tab is forced downwardly as shown in FIG. 4, an inwardly oriented side surface moves against the more inwardly disposed upper surface of the flange, at which point further downward movement is prevented. This movement develops substantial leverage against the outer surface of the container finish, and results in the splitting of the tamper indicating ring prior to the breaking of some of the frangible bridge members, so that with further unthreading, some of the bridges remain unbroken and the split tamper indicating ring remains attached to the skirt of the closure. The entire cross section of the tabs is, therefore, of relatively thick cross section, so that a compressive force is exerted against the relatively thin medially disposed portion of the tamper ring to result in splitting the ring in that area.

By contrast, the presently disclosed structure is directed to the separation of the tamper indicating ring from the closure skirt without splitting the ring, so that it will remain attached to the container as the closure is unthreaded. This is accomplished without the tabs being pivoted to a degree wherein they overlie an inwardly disposed generally vertical surface of a bead to decrease the effective internal diameter of the tamper indicating ring to less than that of the corresponding bead on the container finish as described, e.g. in the McBride U.S. Pat. No. 4,938,370 of Jun. 3, 1990. That structure necessitates a relatively flexible or flabby tab which very often is too thin in cross section to permit operation in a so-called first mode. As a result, the closure must be unthreaded to a considerably greater degree before the frangible bridges interconnecting the ring with the skirt of the closure are broken, often at the limit of the threaded engagement, and without the obtaining of substantial leverage possible only in the first mode of operation.

The present construction, therefore, is directed to the provision of tabs which are of substantial cross section along the length thereof, but which have a hinged interconnection at a location of relatively thin cross section, so that they will pivot instead of flex relative to the tamper indicating ring body as the closure is unthreaded to a relatively limited degree, and exert a force against the tamper ring body which is, for the most part, axially directed relative to the axis of the closure, and results in prompt separation of the tamper ring, substantially at the initiation of the unthreading action.

To accomplish this result, it is necessary that the tab be free to pivot outwardly to readily clear the tamper ring bead on the container finish when the closure is unthreaded, but be limited in inward pivotal movement in an opposite arcuate path of movement to no more than 40 degrees from the axis of the closure. This can be accomplished using a variety of structures. In the principal embodiment, the triangularly shaped projections contact the inner surface of the tamper ring at the lower main body thereof to prevent further movement. This is equally true in the case of the first and second alternate forms. In the third alternate form contact by the tab is made with a radially inwardly extending surface of the lower main body to create a similar effect.

I wish it to be understood that I do not consider the invention to be limited to the precise details of structure illustrated and described in the specification, for obvious modifications will occur to those skilled in the art to which the invention pertains.

I claim:

1. In a threaded closure for sealing a container having a corresponding threaded finish, said closure having a tamper-evident ring frangibly interconnected to said closure at a circular free edge thereof, said container defining an annular recess adjacent the inner end of said threaded finish, the improvement comprising: said tamper-evident ring including an upper edge (44) adjacent points of interconnection with said free edge of said closure, a relatively thin medially disposed portion (48) depending from said upper edge, and a relatively thicker lower annular main body (53) bounded by an upper radially extending surface (44); and a cylindrical inner surface (55), said surfaces (44)(55) meeting at an angularly disposed area (60) of relatively thin cross section; a plurality of radially inwardly directed tabs (61) pivotally secured at said angularly disposed area (60), said tabs each including a surface (70) extending radially inwardly of said area, a portion of said surface of said tabs (70) selectively contacting said cylindrical inner surface (55) to limit inward movement of said tab during unthreading of said closure.

2. A threaded closure in accordance with claim 1, in which said surface of said tabs is formed by integrally formed projections at each lateral edge of said tabs.

3. A threaded closure in accordance with claim 1, in which said surface of said tabs is supplemented by integrally formed projections at each lateral edge of said tabs.

4. A threaded closure in accordance with claim 1 in which pivotal inward movement of said tabs relative to the axis of said closure is limited to between 20 and 49 degrees.

5. In a threaded closure for sealing a container having a corresponding threaded finish, said closure having a tamper-evident ring frangibly interconnected to said closure at a circular free edge thereof, said container defining an annular recess adjacent the inner end of said threaded finish, the improvement comprising: said tamper-evident ring including an upper edge adjacent points of interconnection with said free edge of said closure, a relatively thin medially disposed portion (48) depending from said upper edge, an annular main body (53) of relatively thicker cross section bounded by an upper surface (54) and a cylindrical inner surface (55), said surfaces (54) (55)meeting at an area (60) of relatively thin cross section; plurality of radially inwardly directed tabs (61) each pivotally secured at said area (60) of thin cross section, said tabs (61) each including a surface (68) extending radially inwardly of said area of thin cross section, a portion of said surface of said tabs (68) selectively contacting said cylindrical inner surface (55) to limit inward movement of said tabs during unthreading of said closure.

6. In a threaded closure for sealing a container having a corresponding threaded finish, said closure having a tamper-evident ring frangibly interconnected to said closure at a circular free edge thereof, said container defining an annular recess adjacent the inner end of said threaded finish, the improvement comprising: said tamper-evident ring including an upper edge adjacent points of interconnection with said free edge of said closure, a relatively thin medially disposed portion (48) depending from said upper edge, a radially extending surface (44), and a generally cylindrical inner surface (55), said surfaces meeting at an area (60) of relatively thin cross section; a plurality of radially inwardly directed tabs (61) pivotally secured at said area (60) of thin cross section said tabs each including a plurality of surfaces (70) extending radially inward of said area (60) of thin cross section, a portion of one of said surfaces of said tabs selectively contacting said cylindrical inner surface (55) to limit inward movement of said tabs during unthreading of said closure.

* * * * *